United States Patent [19]

Panazzolo

[11] Patent Number: 4,712,680

[45] Date of Patent: Dec. 15, 1987

[54] REINFORCED SELF-CENTERING PLASTIC CARRIER FOR BOTTLES

[75] Inventor: Aldo Panazzolo, Perrysburg, Ohio

[73] Assignee: Owens-Illinois Plastic Products Inc., Toledo, Ohio

[21] Appl. No.: 845,211

[22] Filed: Mar. 27, 1986

Related U.S. Application Data

[63] Continuation-in-part of Ser. No. 834,133, Feb. 24, 1986, which is a continuation of Ser. No. 663,651, Oct. 22, 1984.

[51] Int. Cl.[4] ..... B65D 65/00

[52] U.S. Cl. ..... 206/427; 206/148; 206/149; 206/194; D9/344

[58] Field of Search ..... 206/141, 142, 148, 149, 206/151, 157, 158, 194, 199, 427; 294/87.2, 87.28; D9/344; 220/72

[56] References Cited

U.S. PATENT DOCUMENTS

| | | | |
|---|---|---|---|
| D. 282,908 | 3/1986 | Panazzolo | D9/344 |
| D. 283,676 | 5/1986 | Kochling | D9/344 |
| 4,139,094 | 2/1979 | Berry et al. | 206/148 |
| 4,206,851 | 6/1980 | Ostrowsky | 215/252 |
| 4,245,685 | 1/1981 | Nemitz et al. | 220/72 |
| 4,308,955 | 1/1982 | Schieser et al. | 220/72 |
| 4,453,630 | 6/1984 | Helms et al. | 206/148 |
| 4,457,426 | 7/1984 | Humphries | 206/148 |
| 4,487,312 | 12/1984 | Heider | 206/148 |
| 4,523,677 | 6/1985 | Schurmann | 206/158 |
| 4,609,106 | 9/1986 | Gentili | 220/72 |

OTHER PUBLICATIONS

Model of Ser. No. 4,453,630, Helms et al.

*Primary Examiner*—Stephen Marcus
*Assistant Examiner*—David T. Fidei
*Attorney, Agent, or Firm*—H. G. Bruss

[57] ABSTRACT

An improved single piece plastic carrier for a plurality of filled and capped bottles in which the neck of each bottle to be carried by the carrier is received in an aperture in the top panel of the carrier and is supported by a pair of spaced apart tabs which extend radially inwardly from the aperture. Each such tab has a substantially greater arcuate extent than the tabs utilized in prior art carriers, and each such tab, therefore, is substantially less yieldable than such prior art tabs. The substantially reduced tab yieldability is advantageous in preventing accidental disengagement of the bottle in the aperture from the carrier. Additionally, the carrier is provided with at least a pair of spaced apart centering lugs near each bottle carrying aperture of the carrier, in the juncture between the top panel of the carrier and the side wall thereof. Such centering lugs help to center the bottles as the carrier is being applied thereto and, after the application of the carrier, such centering lugs further reinforce the aperture to further help to prevent accidental disengagement of a bottle from such aperture. The carrier is suited for the carrying of bottles that are capped with aluminum roll-on closures, especially 28 mm diameter closures of such type.

24 Claims, 8 Drawing Figures

REINFORCED SELF-CENTERING PLASTIC CARRIER FOR BOTTLES

CROSS-REFERENCE TO RELATED APPLICATIONS

This application is a continuation-in-part of my copending application Ser. No. 834,133, filed Feb. 24, 1986, which, in turn, is a continuation of my application Ser. No. 663,651, filed Oct. 22, 1984.

BACKGROUND OF THE INVENTION

1. Field of the Invention

This invention relates to a thermoformed, sheet plastic, semi-rigid carrier for carrying a multiplicity of filled and capped glass or plastic bottles from the upper portions.

2. Description of the Prior Art

U.S. Pat. No. 4,139,094 (Berry, et al) describes a semi-rigid, thermoformed sheet plastic carrier for carrying a multiplicity of filled and capped glass or plastic bottles from the upper portions thereof. In such a carrier each bottle is retained in an opening in a top panel of the carrier by a circular array of yieldable tabs that engage the underside of the cap of the bottle to retain the bottle in the carrier until such time as a user desires to remove the bottle by pulling it through the array of tabs. Each bottle receiving opening of the carrier of the aforesaid U.S. patent is shown as having four of such tabs with adjacent tabs being separated by an enlarged space, the inside diameter of the opening that is defined by the inner type of such tabs exceeding the outer diameter of the closure to be inserted in such opening, and with the width of each such space being almost as great as the width of the inside tip or edge of each of the tabs which it separates. Carriers of the aforesaid type have been widely used in the packaging of filled bottles which are capped with 28 mm aluminum roll-on closures of various types, such closures having been widely utilized in the beverage industry for the past several years. See, for example, U.S. Pat. Nos. 3,601,273 (Kutcher) and 4,007,851 (Walker).

SUMMARY OF THE INVENTION

Plastic carriers of the aforesaid type are usually applied to groups of filled and capped bottles by a machine to attain the carrier application speeds that are desired in most bottling plants and the economies that result therefrom. However, an occasional problem of misalignment between a carrier and the bottles to which it is being applied develops during such machine application of carriers, and when such misalignment occurs, one or more of the bottles to be carried thereby can be improperly inserted in the carrier, which can lead to the accidental release of any of such bottles from the carrier. Further, any such occasional misalignment between a carrier and the associated bottles can result in jamming of the carrier applicating machine, resulting in damage to carriers and to filled and capped bottles being processed in such machine and to lost machine production time during the correction of any such jamming condition.

Another problem associated with carriers of the aforesaid type is that the highest structural loadings that are imposed on such carriers are imposed on the bottle retaining tabs of the apertures thereof, as they resist the release of the bottles carried by such carrier during the carrying of such carrier, especially during the carrying of such carriers in an environment where they are subjected to high frequency vibrations because of the fatigue of the material under loads that are repeatedly applied and removed and reapplied, for example, during the shipment of carriers and associated bottles by truck or rail. Thus, the minimum acceptable carrier sheet thickness is determined by that needed to impart sufficient strength to the bottle engaging tabs, and to the extent that the bottle engaging tabs can be structurally reinforced by the design of the tabs themselves or by the design of nearby portions of the rest of the carrier, the cost of the carrier can potentially be reduced by reducing the thickness and the weight of the carrier sheet without compromising carrier aperture tab resistance to loadings.

According to the present invention there is provided an improved carrier for filled and capped bottles, which carrier has a top panel with openings or apertures therein. Each such opening receives the upper portion of a filled and capped bottle to be carried therein, and each such opening has tabs which project radially inwardly from the periphery of the opening to securely engage the upper portion of the filled and capped bottle that has been inserted in such opening, to prevent the accidental or inadvertent disengagement of such bottle from the carrier.

The carrier of the present invention is provided with improved resistance to the accidental or inadvertent disengagement therefrom of one or more of the filled and capped bottles carried thereby by a novel bottle carrying opening and tab design. According to such novel design, each aperture of the carrier is provided with only two bottle engaging tabs, which tabs are spaced from one another around the periphery of the opening. Each such bottle engaging tab has an arcuate extent which is substantially greater than the arcuate between the tabs, the arcuate extent of each of such tabs thereby being not substantially less than 180°. Because of the arcuate extent of each such arcuate tab, because each such arcuate tab is joined to the structure of the carrier that surrounds the opening that contains such arcuate tab in a pattern which is curvilinear, and because of the rigidity that is imparted to each of such tabs by the curvilinear pattern of the juncture between each such tab and the surrounding structure of the carrier, not only does each such tab have much greater resistance to deflection under load than one of the corresponding tabs of the carrier of U.S. Pat. No. 4,139,094, but, collectively, two such tabs of the carrier of the present invention have greater resistance to deflection under load than the four tabs of the carrier of U.S. Pat. No. 4,139,094. Thus, for a given carrier sheet thickness, the openings of the carrier of the present invention are more resistant to the accidental disengagement of bottles from such carrier than the carrier of U.S. Pat. No. 4,139,094, and if it is not desired to increase the resistance to accidental disengagement of bottles from such carrier, the carrier sheet thickness may be reduced without reducing the resistance of the carrier of the present invention to accidental bottle disengagement, relative to that of the carrier of U.S. Pat. No. 4,139,094.

The problem of the proper centering of a carrier of U.S. Pat. No. 4,139,094 with respect to the filled and capped bottles to which it is being applied is solved, in the carrier of the present invention, by providing a multiplicity of inwardly and downwardly directed projections or lugs in the carrier at the juncture of the top panel and the depending wall, preferably at least one of such projections being radially aligned with each of the bottle receiving openings of the carrier. Each of such lugs preferably extends radially inwardly substantially to the periphery of a circle on which the roots or bottoms of the spaces between the bottle supporting tabs lie, and each of such lugs, therefore, serves to assist in the centering of the top of the capped bottle with respect to the opening of the carrier into which the upper portion of such bottle is to be inserted during the application of the carrier to the bottles.

At least one of such bottle centering lugs at each bottle receiving opening in the carrier is preferably located between the ends of one of the bottle supporting tabs of such opening, and when so located, the bottle centering lugs not only serve to assist in the centering of the carrier and the bottles during the application of the carrier to the bottles, but at least one of the tabs in each such opening is further structurally reinforced by such lug to be even more resistant to deflection than a corresponding tab of the carrier of U.S. Pat. No. 4,139,094. Preferably, each bottle receiving opening of the carrier of the present invention has at least two centering lugs associated therewith, such centering lugs preferably being spaced apart and both being positioned between the ends of one of the bottle supporting tabs of the opening that incorporates such bottle supporting tabs, for optimum centering affect between the carrier and the bottles during the application of the carrier to the bottles and for optimum reinforcement of such bottle supporting tab.

Accordingly, it is an object of the present invention to provide an improved carrier for carrying a plurality of filled and capped bottles from the upper portions of such bottles. More particularly, it is an object of the present invention to provide a carrier for carrying a plurality of filled and capped bottles from the upper bottles of such bottles which has improved resistance to disengagement of one or more of the bottles from such carrier. It is also an object of the present invention to provide a carrier for carrying a plurality of filled and capped bottles from the upper portions of such bottles, which carrier is self-centering with respect to such bottles during the application of the carrier to the bottles. It is a corresponding object of the present invention to provide a package that includes a plurality of filled and capped bottles and an improved carrier that has been applied to the upper portions of such filled and capped bottles to permit the carrying of such bottles.

For a further understanding of the present invention and the objects thereof, attention is directed to the drawings and the following brief description thereof, to the detailed description of the preferred embodiment and to the appended claims.

DETAILED DESCRIPTION OF THE PREFERRED EMBODIMENT

Figure 1:
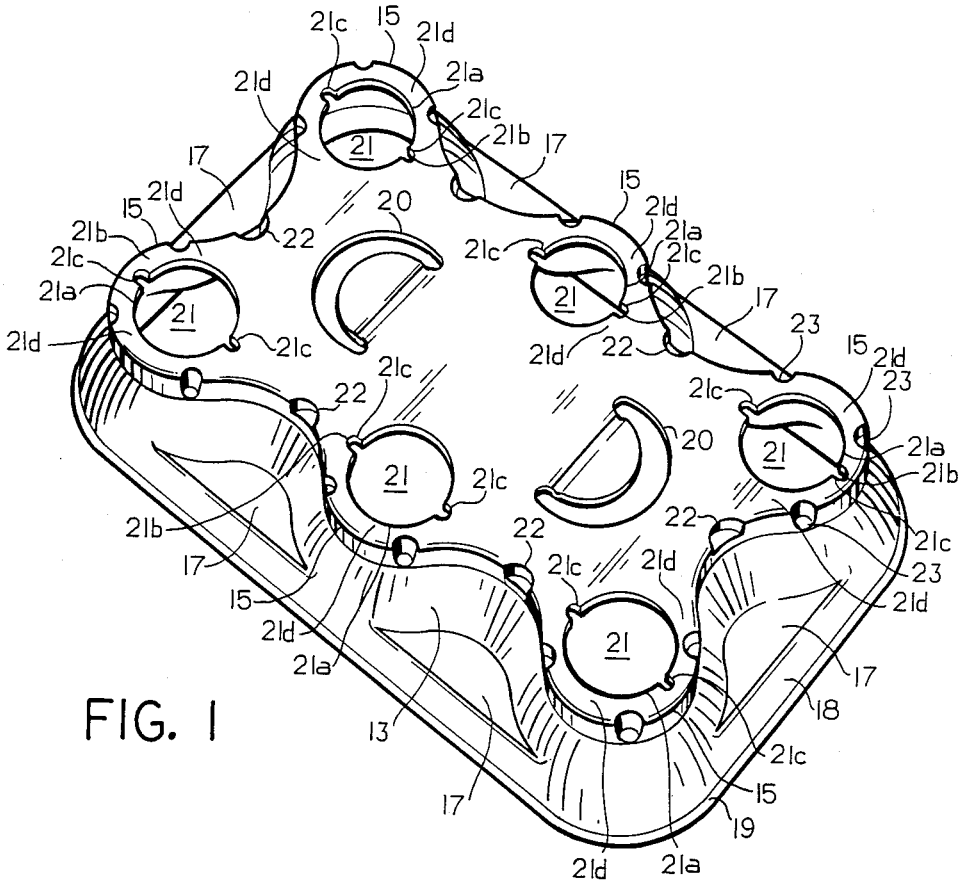
FIG. 1 is a perspective view of the preferred embodiment of a six-bottle carrier according to the present invention.
Figure 3:
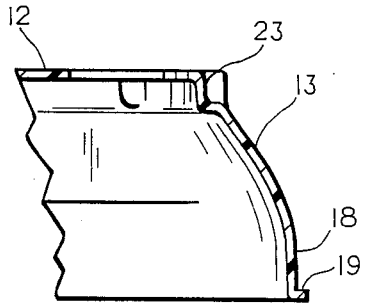
FIG. 3 is a fragmentary sectional view, at a somewhat enlarged scale, taken on line 3—3 of FIG. 2.
Figure 5:
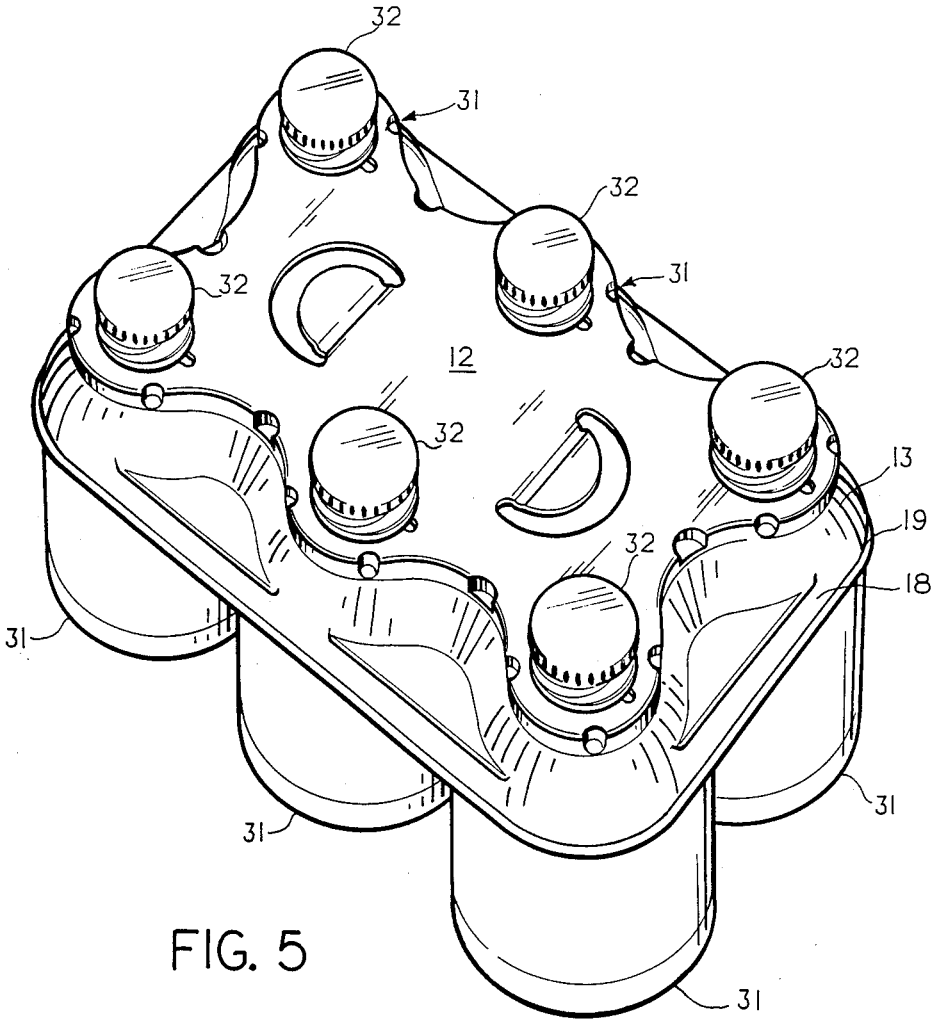
FIG. 5 is a perspective view of the carrier of FIG. 1 after application of such carrier to six filled and capped bottles.
Figure 4:
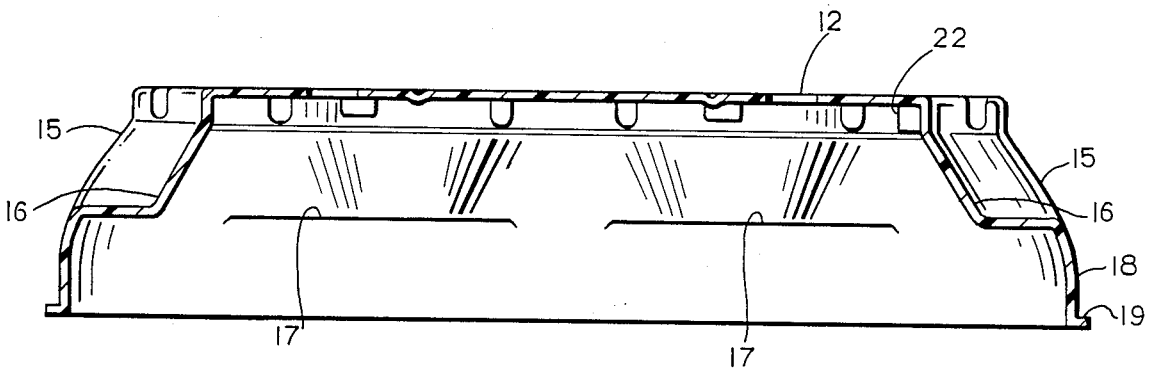
FIG. 4 is a sectional view taken on line 4—4 of FIG. 2.

FIG. 1 illustrates a six-bottle carrier, generally indicated by reference numeral 11, which may be formed in a single piece from a sheet of a suitable semi-rigid thermoplastic material by a process which includes a thermoforming operation to shape the sheet into the illustrated complex three-dimensional shape. As is shown in FIG. 5, the carrier 11 is designed to be applied to six filled and capped beverage bottles 31, the cap or closure of each of such bottles being identified by the reference numeral 32. The carrier 11 may be dimensionally designed to be used with any of the popular sizes and types of bottles used in the packaging of single service quantities of a beverage, e.g., 16 oz. glass or plastic bottles, and a suitable carrier for six of such 16 oz. glass or plastic beverage bottles can be formed from a sheet of high density polyethylene of approximately 24 mil (0.024 in.) sheet thickness.

The carrier 11 has a top panel 12 and a peripheral wall 13 extending from and along the periphery of the top panel 12, and the peripheral wall 13 has six (for a six-bottle carrier) outwardly convex arcuate first wall portions 15 and six outwardly concave second wall portions 16, each of which is disposed between a pair of adjacent first wall portions 15. By this arrangement the first wall portions 15 and the second wall portions 16 blend in a continuous manner to define six internal compartments for containers. The carrier 11 also has six ledges 17 extending outwardly from the second wall portions 16, and a peripheral skirt 18 which depends downwardly from the ledges 17 and from the first wall portions 15. The peripheral skirt 18, at its lower margin, merges into a lip 19 which extends outwardly therefrom.

Figure 2:
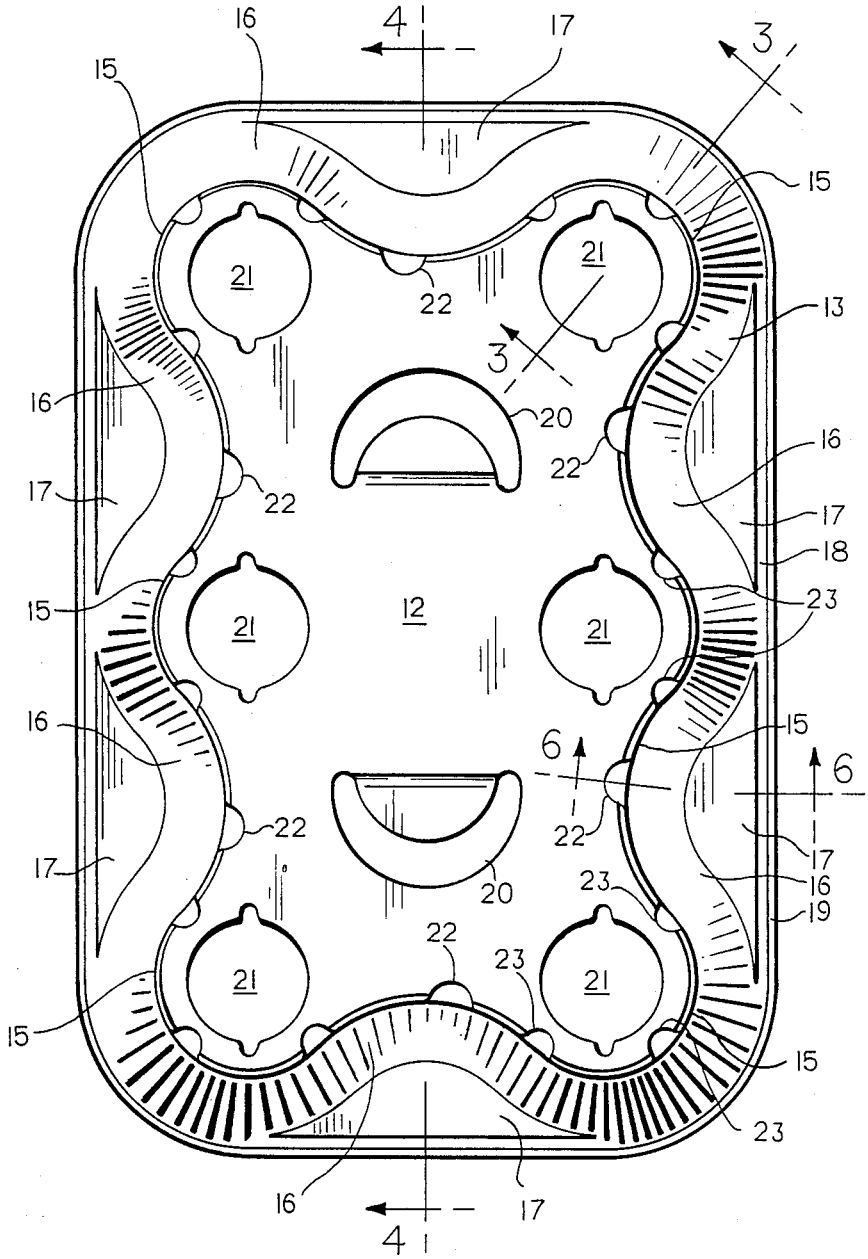
FIG. 2 is a top plan view of the carrier of FIG. 1.

The top panel 12 of the carrier 11 is provided with six irregularly-shaped but generally circular bottle neck receiving apertures 21. The inside diameter **21*a* of each of the apertures 21 is sized to provide an interference fit with the bottom of the closure 32 of a bottle neck which is inserted through the aperture, as is shown in FIG. 5, and the outside diameter 21*b* of each such aperture 21 is sized to provide a clearance fit with such bottle closure. As is shown in FIGS. 1 and 2, each of the apertures 21 has a pair of narrow spaced apart slots 21*c*. The slots 21*c* open into the inside diameter 21*a* of the associated aperture 21 and extend to its outside diameter 21*b*, and form a pair of tabs 21*d* which extend between the slots 21*c*** on either side thereof.

For any given bottle closure size the tabs **21*d* will be considerably wider than their counterparts in the carrier of U.S. Pat. No. 4,139,094 because of the fact that the slots 21*c* are considerably narrower and because, as shown, there are only two such tabs in each aperture as opposed to four tabs in the bottle receiving apertures of the aforesaid U.S. patent. Each tab 21*d*, therefore, will have an arcuate extent of nearly 180° and will be considerably less capable of yielding downwardly with respect to the bottom of the closure which is positioned adjacent thereto. Thus, the added rigidity of each tab 21***d* will help to prevent it from yielding or deflecting downwardly under the weight of one of the beverage bottles 31 being carried in the aperture 21 that includes such tab 21*d*. This, in turn, will help to prevent the tabs 21*d* for a given aperture 21 from yielding to permit the accidental disengagement of the associated bottle 31 due to the weight of the bottle 31, especially as such disengagement may result from fatigue of the tabs 21*d* due to vibrations or due to inertia when a carrier 11 and associated bottles is suddenly lifted.

Like the carrier in the aforesaid U.S. Pat. No. 4,139,094, the carrier 11 of the present invention is provided with a pair of finger receiving apertures 20 in the top panel 12 to permit the user to conveniently carry the package that includes the carrier 11 and the bottles 31 contained therein. This will permit the package to be picked up repeatedly throughout its life from the bottling plant to the household of a consumer, and when a properly designed carrier is properly applied to the associated bottles, they will remain securely engaged by the carrier throughout this cycle until someone decides to remove the bottles or any of them therefrom.

The bottles 31 of the type typically carried by a carrier 11 of the type illustrated are of the single service type, e.g., bottles which are designed to contain 10 oz. or 16 oz., currently two very popular bottle sizes, and they are generally provided with 28 mm closure-receiving finish portions. The carrier 11 is particularly designed for use with bottles 31 which are capped with metallic closures, such as aluminum roll-on closures. The bottle engaging tabs 21*d* of the carrier 11 are quite stiff, and could cause damage to a molded plastic closure, especially to the tamper-indicating band which is customarily a part of such molded plastic closure. However, such potential closure damage is not possible when the bottles are capped with aluminum roll-on closures, because of the strength and hardness of the aluminum alloy sheet that such closures are formed from.

A multiplicity of similar carriers including the carrier 11 are normally shipped, from the carrier manufacturing plant to the bottling plant where such carriers are applied to filled and capped bottles, in closely nested stacks of such carriers to minimize the volume occupied by such carriers, and, thus, the shipping cost. However, such shipment of closely nested carriers creates the problem that such carriers will become jammed, or wedged together, due to the weight of a stack of such carriers, especially when the weight of such carriers is augmented by the inertia loads that such carriers can encounter during such shipment. To prevent such jamming, each of the carriers 11 is provided with one or more inwardly and downwardly extending stacking lugs 22 which are formed in the carrier 11 at the juncture of the top panel 12 and the peripheral wall 13, preferably in at least one outwardly concave second wall portion 16. Preferably, each carrier 11 is provided with one of such stacking lugs 22 in each of the second wall portions for maximum resistance to jamming of nested carriers in a stack. Thus, the six-bottle carrier 11 of the embodiment of FIGS. 1 through 6 has six of such stacking lugs 22, one for each of the six second wall portions 16 in such six-bottle carrier.

The carrier 11 is also provided with at least one inwardly and downwardly extending centering lug 23 near each of the apertures 21 in the juncture between the top panel 12 and the outwardly convex first wall portion 15 of the peripheral wall 13 that is near such aperture 21. Each such centering lug 23 has a downward extent that is no greater than the downward extent of the stacking lugs 22 so that the centering lugs 23 do not interfere with the stacking function of the stacking lugs 22. Each such centering lug 23 preferably extends radially with respect to the aperture 21 that it is near and, preferably, each aperture 21 has at least two of such centering lugs 23 extending radially with respect thereto. Preferably, each of the centering lugs 23 is positioned with respect to the slots 21*c* of the aperture 21 that such centering lugs 23 are near, so that such centering lugs lie between the ends of one of the tabs 21*d* of such aperture, for optimum structural reinforcement of such tab 21*d*.

Each of the centering lugs 23 extends radially inwardly toward the aperture 21 that such centering lug is near, preferably approximately to the outside diameter 21*d* of the aperture 21. Thus, the interior of the centering lugs 23 that are near a given aperture will lie very close to the outside of the cap 32 on one of the beverage bottles 31 as the upper portion of such beverage bottle is being inserted into such aperture, or as the aperture is being inserted over the bottle in the case of a carrier applicating technique that is accomplished by moving a carrier with respect to stationary filled and capped bottles. In any case, the centering lugs will help to center the carrier on the filled and capped bottles to which such carrier is being applied during the application of the carrier to the filled and capped bottles, to thereby help to prevent jamming of the applicating machine, or any misapplication of the carrier with respect to any of the filled and capped bottles to which it is being applied that does not result in jamming.

The centering lugs 23 further stiffen the tabs 21*d* of the aperture 21 that such centering lugs extend radially from and thereby further assist in preventing accidental disengagement of the filled and capped bottle 31 from such aperture. Of course, under sufficient hand pressure, the bottle can be removed from such aperture 21 at the time that it is desired to consume the contents of such bottle 31, or to store such bottle 31 independently from the carrier 11 in which it was shipped in a cooler or vending machine. What is important in the shipment of the bottles 31 in a carrier 11 is that accidental or inadvertent disengagement of the bottles 31 from the carrier 11 not occur, and the use of a pair of each of nearly 180° arcuately long tabs 21*d* of the apertures 21 coupled with the reinforcing of one of such tabs 21*d* of each aperture 21 that results from the presence of the centering lugs 23, both contribute to the resistance of the carrier 11 to accidental disengagement of bottles 31 therefrom.

Figure 7:
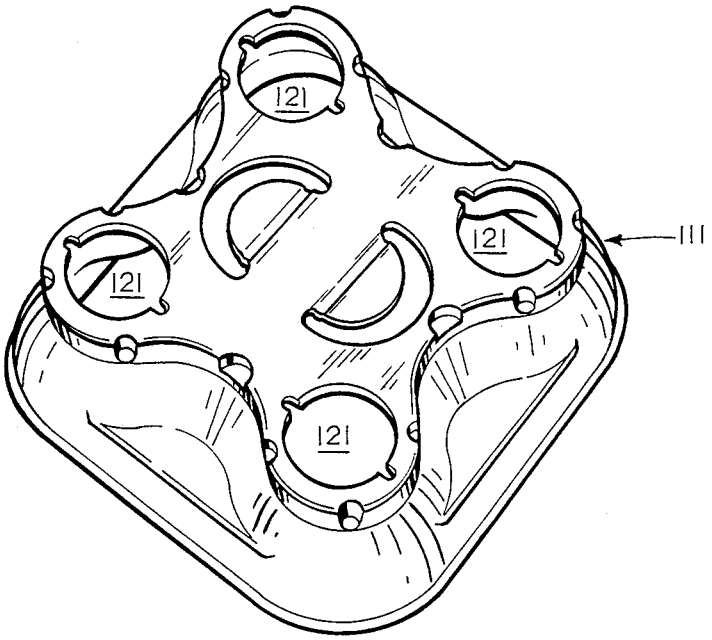
FIG. 7 is a perspective view of the preferred embodiment of a four-bottle carrier according to the present invention.
Figure 6:
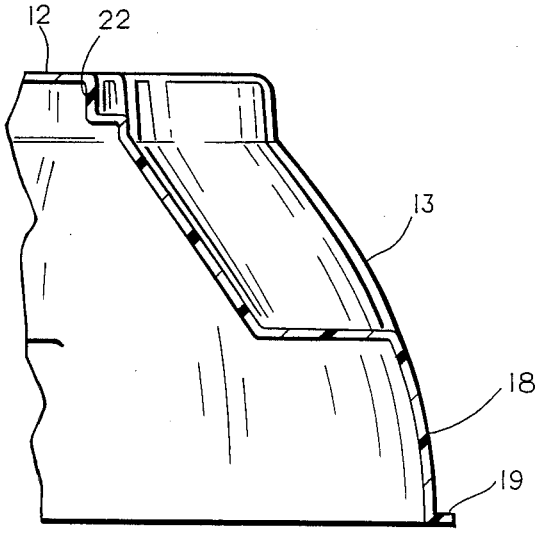
FIG. 6 is a fragmentary sectional view taken on line 6—6 of FIG. 2.

FIG. 7 illustrates an alternative embodiment of a carrier, indicated generally by reference numeral 111, which is designed for the packaging of four single service bottles and which is provided, therefore, with four bottle receiving apertures 121. Except for the number of filled and capped bottles to be packaged in the carrier 111 and the structural differences which result from such difference, the carrier 111 may be considered to be the same in construction as the carrier 11 of the embodiment of FIGS. 1 through 6. When designed for use with single service bottles, the carrier 111 may also be advantageously formed from high density polyethylene of no more than approximately 24 mil thickness. The dimensional characteristics of the apertures 121 of the carrier 111 may, therefore, be identical to those of the apertures 21 of the carrier 11 when used with bottles and closures of the same type.

Figure 8:
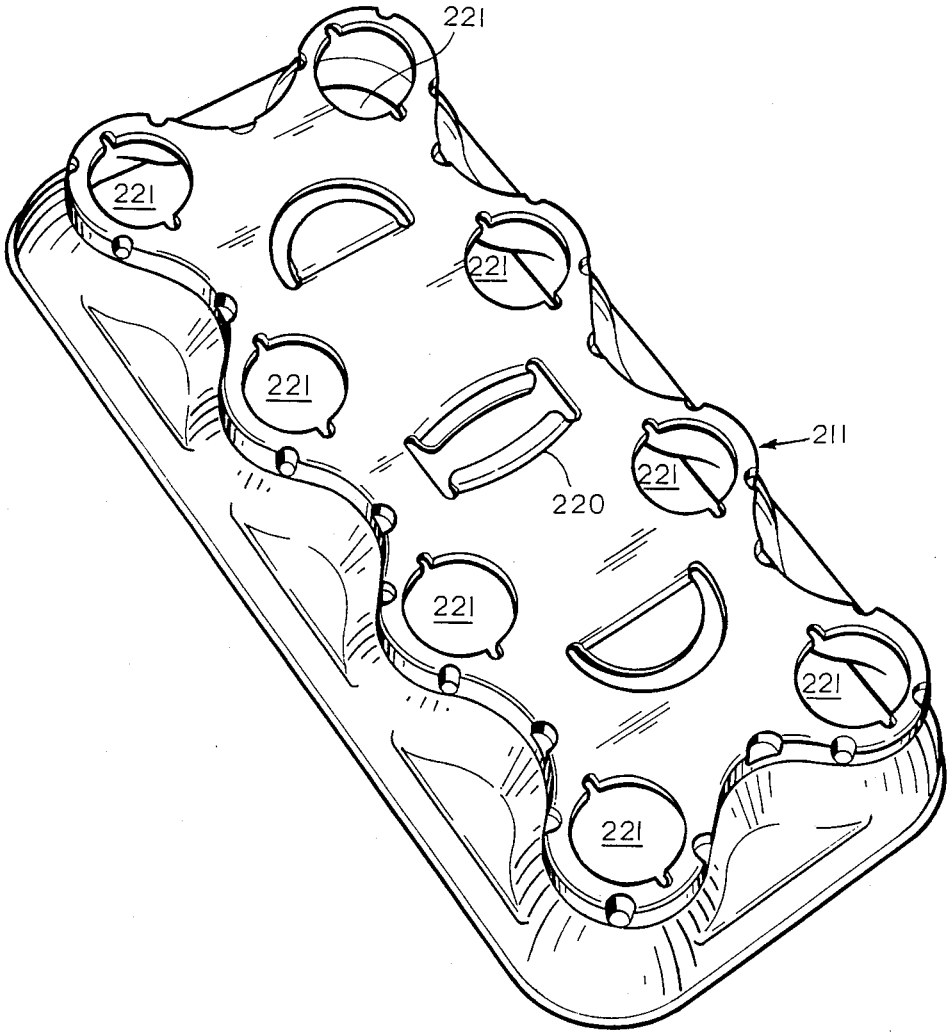
FIG. 8 is a perspective view of the preferred embodiment of an eight-bottle carrier according to the present invention.

FIG. 8 illustrates an alternative embodiment of a carrier, indicated generally be reference numeral 211, which is designed for the packaging of eight single service bottles. Thus, the carrier 211 is provided with eight bottle receiving apertures 221. The carrier 221 is provided with an extra finger receiving aperture 220 to permit the carrier to be carried from either end thereof. Otherwise, except for the number of filled and capped bottles to be packaged in the carrier 211 and the structural differences which result from such difference, the carrier 211 may be considered to be the same in construction as the carrier 11 of the embodiment of FIGS. 1 through 6. When designed for use with single service bottles, the carrier 211 may also be advantageously formed from high density polyethylene of no more than approximately 25 mil thickness. The dimensional characteristics of the apertures 221 of the carrier 211 may, therefore, be identical to those of the apertures 21 of the carrier 11 when used with bottles and closures of the same type.

Although the best mode contemplated by the inventor for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed is:

1. A single piece carrier for carrying a plurality of filled and capped bottles from the upper portions thereof, said carrier comprising:

a top panel having an outer periphery;

a peripheral wall extending downwardly from said outer periphery of said top panel, said peripheral wall having plural outwardly convex arcuate first wall portions and plural outwardly concave arcuate second wall portions disposed intermediate said first wall portions, said second wall portions blending with said first wall portions to define plural compartments for said bottles, said peripheral wall merging with said top panel at a juncture between said peripheral wall and said outer periphery of said top panel;

a plurality of spaced apart apertures in said top panel, each of said plurality of apertures being adapted to have the upper portion of one of said plurality of bottles inserted thereinto, each of said plurality of apertures having a plurality of tabs extending radially inwardly from the periphery of said each of said plurality of apertures, each of said plurality of apertures further having a plurality of spaces, a space being provided between adjacent tabs, each of said spaces having a radial depth and a bottom to said radial depth, the bottoms of said plurality of spaces defining a circle having a diameter, said plurality of tabs in said each of said plurality of apertures being adapted to releasingly engage and support said one of said plurality of bottles, at least an arcuate portion of said each of said plurality of apertures being disposed adjacent to and generally concentric with at least an arcuate portion of one of said plural outwardly convex first wall portions of said peripheral wall and forming an arcuate strip with said at least an arcuate portion of one of said plural outwardly convex first wall portions of said peripheral wall; and at least two spaced apart centering and reinforcing lug projections adjacent each of said plurality of spaced apart apertures in said top panel, each of said centering and reinforcing lug projections extending radially inwardly and downwardly from said juncture between said peripheral wall and said top panel in said arcuate strip between said at least an arcuate portion of said one of said plural outwardly convex first wall portions of said peripheral wall and said at least an arcuate portion of said each of said plurality of apertures, each of centering and reinforcing lug projections extending radially inwardly substantially to said circle and serving to help to center said upper portion of said one of said plurality of bottles as said upper portion is inserted into said each of said plurality of apertures; said at least two spaced apart centering and reinforcing lug projections serving to reinforce at least one of said tabs in said each of said plurality of apertures.

2. A package comprising:

a plurality of filled and capped beverage bottles; and a single piece carrier for carrying each of said plurality of filled and capped bottles from the upper portions thereof, said carrier comprising:

a top panel having an outer periphery;

a peripheral wall extending downwardly from said outer periphery of said top panel, said peripheral wall having a plural outwardly convex arcuate first wall portions and plural outwardly concave arcuate second wall portions disposed intermediate said first wall portions, said second wall portions blending with said first wall portions to define plural compartments for said bottles, said peripheral wall merging with said top panel at a juncture between said peripheral wall and said outer periphery of said top panel;

a plurality of spaced apart apertures in said top panel, each of said plurality of apertures having the upper portion of one of said plurality of filled and capped bottles inserted thereinto, each of said plurality of apertures having a plurality of tabs extending radially inwardly from the periphery of said each of said plurality of apertures, each of said plurality of apertures further having a plurality of spaces, a space being provided between adjacent tabs, each of said spaces having a radial depth and a bottom to said radial depth, the bottoms of said plurality of spaces defining a circle having a diameter, said plurality of tabs in said each of said plurality of apertures releasingly engaging and supporting said one of said plurality of bottles, at least an arcuate portion of said each of said plurality of apertures being disposed adjacent to and generally concentric with at least an arcuate portion of one of said plural outwardly convex first wall portions of said peripheral wall forming and arcuate strip with said at least an arcuate portion of one of said plural outwardly convex first wall portions of said peripheral wall; and at least two spaced apart centering and reinforcing lug projections adjacent each of said plurality of spaced apart apertures in said top panel, said centering and reinforcing lug projections extending radially inwardly and downwardly from said juncture between said peripheral wall and said top panel in said arcuate strip between said at least an arcuate portion of said one of said plural outwardly convex first wall portions of said peripheral wall and said at least an arcuate portion of said each of said plurality of apertures, each of said centering and reinforcing lug projections serving to help to center said upper portion of said one of said plurality of filled and capped bottles as said upper portion is inserted into said each of said plurality of apertures, said at least two centering and reinforcing lug projections further serving to reinforce at least one of said spaced apart tabs in said each of said plurality of apertures.

3. A single piece carrier according to claim 1 wherein each of said plurality of apertures comprises two of said tabs, said two of said tabs having first and second arcuate extents, respectively, said two tabs having two spaced apart spaces therebetween, said two spaces having third and fourth arcuate extents, respectively, each of said first and second arcuate extents being substantially greater than each of said third and fourth arcuate extents.

4. A single piece carrier according to claim 3 wherein the arcuate extent of each of said two of said tabs is nearly 180°.

5. A package according to claim 2 wherein each of said plurality of apertures in said top panel of said single piece carrier comprises two of said tabs, said two spaced apart of said tabs having first and second arcuate extents, respectively, said two tabs having two spaces therebetween, said two spaced apart spaces having third and fourth arcuate extents, respectively, each of said first and second arcuate extents being substantially greater than each of said third and fourth arcuate extents.

6. A package according to claim 5 wherein the arcuate extent of each of said two of said tabs is nearly 180°.

7. A single piece carrier according to claim 3 wherein the arcuate extent of each of said two of said tabs is substantially equal to the arcuate extent of the other of said two of said tabs and wherein the arcuate extent of each of said two spaces is substantially equal to the arcuate extent of the other of said two spaces.

8. A single piece carrier according to claim 7 wherein said at least one centering and reinforcing lug projection adjacent each of said apertures in said top panel comprises at least two spaced apart centering and reinforcing lug projections.

9. A single piece carrier according to claim 1 wherein said carrier is formed from a sheet of high density polyethylene by thermoforming, the original thickness of said sheet being not substantially greater than 0.024 inch.

10. A single piece carrier according to claim 3 wherein said carrier is formed from a sheet of high density polyethylene by thermoforming, the original thickness of said sheet being not substantially greater than 0.024 inch.

11. A single piece carrier according to claim 7 wherein said carrier is formed from a sheet of high density polyethylene by thermoforming, the original thickness of said sheet being not substantially greater than 0.024 inch.

12. A single piece carrier according to claim 4 wherein said carrier is formed from a sheet of high density polyethylene by thermoforming, the original thickness of said sheet being not substantially greater than 0.024 inch.

13. A single piece carrier according to claim 8 wherein said carrier is formed from a sheet of high density polyethylene by thermoforming, the original thickness of said sheet being not substantially greater than 0.024 inch.

14. A single piece carrier according to claim 1 wherein said plurality of spaced apart apertures in said top panel comprises six apertures, said six apertures being arranged in two rows of three apertures each, each of said six apertures having a center, the center of each of said three apertures in each of said two rows being aligned with the center of each of the other two apertures in said each of said two rows.

15. A single piece carrier according to claim 1 wherein said plurality of spaced apart apertures in said top panel comprises four apertures.

16. A single piece carrier according to claim 1 wherein said plurality of spaced apart apertures in said top panel comprises eight apertures, said eight apertures being arranged in two rows of four apertures each, each of said four apertures having a center, the center of each of said four apertures in each of said two rows being aligned with the center of each of the other three apertures in said each of said two rows.

17. A package according to claim 5 wherein the arcuate extent of each of said two of said spaced apart tabs is substantially equal to the arcuate extent of the other of said two of said spaced apart tabs and wherein the arcuate extent of each of said two spaces is substantially equal to the arcuate extent of the other of said two spaces.

18. A package according to claim 2 wherein said single piece carrier is formed from a sheet of high density polyethylene by thermoforming, the original thickness of said sheet being not substantially greater than 0.024 inch.

19. A package according to claim 2 wherein each of said plurality of filled and capped beverage bottles is capped with a rolled-on metallic closure.

20. A package according to claim 19 wherein said rolled-on metallic closure with which said each of said plurality of filled and capped beverage bottles is capped has a nominal diameter of 28 mm.

21. A package according to claim 20 wherein said each of said plurality and capped beverage bottles is filled with not substantially more than 16 fluid oz. of a beverage.

22. A package according to claim 21 wherein said plurality of filled and capped beverage bottles comprises six bottles, and wherein said plurality of spaced apart apertures in said top panel of said single piece carrier comprises six apertures; each of said six apertures having the upper portions of one of said six bottles inserted thereinto, said six apertures being arranged in two rows of three apertures each, each of said six apertures having a center, the center of each of said three apertures in each of said two rows being aligned with the center of each of the other two apertures in said each of said two rows.

23. A package according to claim 21 wherein said plurality of filled and capped beverage bottles comprises eight bottles, and wherein said plurality of spaced apart apertures in said top panel of said single piece carrier comprises eight apertures, each of said eight apertures having the upper portion of one of said eight bottles inserted thereinto, said eight apertures being arranged in two rows of four apertures each, each of said four apertures having a center, the center of each of said four apertures in each of said two rows being aligned with the center of each of the other three apertures in said each of said two rows.

24. A package according to claim 21 wherein said plurality of filled and capped beverage bottles comprises four bottles and wherein said plurality of said spaced apart apertures in said top panel of said single piece carrier comprises four apertures, each of said four apertures having the upper portion of one of said four bottles inserted thereinto.

* * * * *